US008186439B2

(12) United States Patent
Lauderdale

(10) Patent No.: US 8,186,439 B2
(45) Date of Patent: May 29, 2012

(54) CONTROLLER FOR A HYDRAULICALLY OPERATED DOWNHOLE TOOL

(75) Inventor: Donald P. Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 535 days.

(21) Appl. No.: 11/960,274

(22) Filed: Dec. 19, 2007

(65) Prior Publication Data

US 2009/0159290 A1 Jun. 25, 2009

(51) Int. Cl.
*E21B 43/00* (2006.01)

(52) U.S. Cl. ..... 166/331; 166/375

(58) Field of Classification Search ..... 166/375, 166/331, 320, 384, 330, 383, 240
See application file for complete search history.

(56) References Cited

U.S. PATENT DOCUMENTS

| | | | | |
|---|---|---|---|---|
| 2,830,119 | A * | 4/1958 | Zimmerman | 379/40 |
| 3,797,591 | A * | 3/1974 | Berryman | 175/296 |
| 4,782,897 | A | 11/1988 | Zeller | |
| 5,488,989 | A * | 2/1996 | Leising et al. | 166/255.3 |
| 5,718,291 | A | 2/1998 | Lorgen et al. | |
| 6,131,663 | A | 10/2000 | Henley et al. | |
| 6,491,106 | B1 * | 12/2002 | Simonds | 166/375 |
| 6,722,437 | B2 | 4/2004 | Vercaemer et al. | |
| 6,889,771 | B1 * | 5/2005 | Leising et al. | 166/373 |
| 6,948,561 | B2 | 9/2005 | Myron | |
| 7,210,534 | B2 | 5/2007 | Hayter et al. | |
| 7,594,542 | B2 * | 9/2009 | Loretz et al. | 166/320 |
| 2007/0187106 | A1 * | 8/2007 | Wolters | 166/313 |
| 2009/0095463 | A1 * | 4/2009 | Swan et al. | 166/53 |

OTHER PUBLICATIONS

Akers, T.J., "Jetting of Structural Casing in Deepwater Environments: Job Design and Operational Practices", SPE 102378, Sep. 2006, 1-15.
Hong, K.C., et al., "New Methods for Controlled Injection of Stream into Multiple Sands", SPE 15472, Oct. 1986, 1-8.
Giroux; Richard, et al., "Formation Treating with Coiled-Tubing-Conveyed Straddle Tools", SPE 68354, Mar. 2001, 1-13.

* cited by examiner

*Primary Examiner* — Daniel P Stephenson
*Assistant Examiner* — Kipp Wallace
(74) *Attorney, Agent, or Firm* — Steve Rosenblatt

(57) ABSTRACT

A hydraulic control system can be used on a downhole choke and has the feature of moving a travel stop for a sliding sleeve using discrete j-slot mechanisms for selectively moving the stop in either one of two opposed directions. The valve can be incrementally opened further with pressure cycling on an opening chamber. The valve can be immediately put to the closed position with pressure on a closing chamber. After closing, the valve can assume its former open position or other selected less open positions by reconfiguring the travel stop while the valve stays in the closed position In order to achieve a higher open percent after closing, one or more pressure cycles must be applied to the open chamber after the valve is reopened to the position it was in before it was closed.

20 Claims, 7 Drawing Sheets

CONTROLLER FOR A HYDRAULICALLY OPERATED DOWNHOLE TOOL

FIELD OF THE INVENTION

The field of the invention is control systems for hydraulically operated downhole tools and more particularly sliding sleeve valves that operate in multiple positions including fully open and closed.

BACKGROUND OF THE INVENTION

Flow during production is regulated by a valve called a choke. The typical design for a choke comprises a body having a series of lateral ports and a sliding sleeve that has a matching port layout. A hydraulic system is used to move the insert sleeve in opposed directions. The hydraulic system also controlled the movement of the insert sleeve broadly in two different ways, both of which will be described in detail below.

In the J-slot design cycles of pressure application and removal made a pin follow a j-slot. A lug also on the movable member with the pin followed the pattern defined by the j-slot and with each cycle of application and removal of pressure the lug would encounter a different fixed travel stop that would define a different amount of percentage open for the valve. In one known design of the HCM-A choke offered by Baker Hughes Incorporated the j-slot allows the insert sleeve to go from a diffused position where it is not totally closed to various open positions with the j-slot pattern having two open passages to allow the lug an extra travel distance so that the valve could go to the fully open or fully closed positions.

In a modification to this valve the hydraulic control system was designed to move the insert sleeve a fixed amount for each pressure up cycle. Removal of the pressure in the second part of each cycle would simply leave the insert sleeve where it was and the next application of pressure would incrementally move the insert sleeve by an amount related to the displaced volume of a piston. Any time the pressure was applied to another control line the insert sleeve would go to the fully closed position.

The details of both these designs and their shortcomings that lead to the development of the present invention will now be described.

Referring to FIGS. 1 and 2, a valve housing 10 has control lines 12 and 14 that extend to opposite sides of piston 16. Piston 16 is connected to insert sleeve 18 for tandem movement. Insert sleeve 18 has a hole pattern 20 that moves up and down into and out of alignment with openings 22 in the housing 10. Seals 24 and 26 straddle ports 22 so that when openings 20 are not between seals 24 and 26 the valve is fully closed. On the other hand when the ports 20 are between seals 24 and 26, as shown in FIG. 1, then the valve is in the diffused position where some flow is possible between ports 20 and 22 through diffuser 28. Alternating pressure application between lines 12 and 14 forces relative movement of pin 30 in the j-slot pattern 32. A series of stair step travel stops 34 define how much more open the valve gets in each pressure cycle. The other half of each cycle has the lug 36 landing on the same spot 38 to define the diffused position shown in FIG. 1. In each pressure cycle, the lug 36 lands on a different step 34 to represent another opening increment. After a predetermined number of cycles the lug 36 can go to landing 40 for a fully closed position where the openings 20 are no longer between seals 24 and 26. In the very next cycle it can go to fully open when lug 36 is allowed to keep traveling by slot 41 until it hits stop 42.

This design does not allow the valve to always be closed with a single command. The design also usually requires multiple commands to reopen the valve after closure to a desired position. This mode of operation can result in additional wear on the ports 20 and 22. In some instances, operators wanted the ability to step the valve to different opening percentages but to also have the ability to snap it closed without having it go through any steps. The design in FIGS. 1 and 2 couldn't do this. What it could do is shown in FIG. 3. In each cycle it could open incrementally more and go to a diffused position where flow through it was fairly close to nothing. As a result a spike pattern of percent open was created and no provisions existed for a rapid close by skipping any part of the sequence illustrated in the j-slot of FIG. 2.

FIG. 4 represents a modification of the original design in FIGS. 1 and 2 that works on the principle of using a predetermined displaced volume to get a predetermined movement of an insert sleeve. Rather than going to almost closed in each cycle the insert sleeve just stays in position until the next cycle bumps it a finite amount proportional to the displaced hydraulic fluid volume. Another feature of this system is that it can be taken to closed immediately by applying pressure on one of the control lines.

The design in-FIG. 4 includes the following components: Line 44 supplies opening pressure to the mechanism and is connected to lines 48 and 46. Line 48 supplies pressure to piston 50. Line 46 supplies pressure to plunger 76 which is connected to piston 74, lines 68, 66 and 90 furnish pressure from the control mechanism to the valve 62 to cause the valve to open. Line 92 furnishes pressure to the valve to cause it to close. Piston 50 is used to move the valve from the fully closed position to the diffused position (such as is shown in FIG. 1). Piston 74 is used to move the valve sequentially to different opening positions. Spring 84 causes piston 74 to move to the left when pressure is bled off of line 44. The surface 86 of plunger 76 allows fluid to bypass plunger 76 during its movement to the left.

The operation of this control system will now be described. Initial application of pressure to line 44 will transmit through line 48 causing Piston 50 to move to the right until it stops and seals at face 94. This causes fluid in chamber 64 to move through lines 66 and 90 causing valve 62 to move from the closed position to the diffused position. Continued application of pressure to line 44, which is also communicating through Line 46 with plunger 76, will now cause plunger 86 and piston 74 to move to the right compressing spring 84 and causing fluid in chamber 70 to move through lines 68 and 90 moving valve 62 from the diffused position to the first open position. At this point, elimination of pressure in line 44 will allow spring 84 to move piston 74 and plunger 76 to the left. The design of plunger 76 includes the surface 86 which allows fluid from lines 44 and 46 to bypass plunger 76 during this leftward movement. Piston 50 does not move and stays in contact with face 94. A second application of pressure to line 44 will communicate trough line 46 to plunger 76 causing it to again move to the right which induces fluid to flow from chamber 70, through lines 68 and 90 to valve 62, moving valve 62 from opening position number 1 to opening position number 2. This elimination and application of pressure to line 44 will cause the valve 62 to consecutively move to opening positions 3, 4, 5, etc.

Any time the above opening sequence is interrupted by elimination of pressure from line 44 combined with application of pressure to line 92, full closure of the valve 62 is achieved. During this closure, fluid is exhausted from valve 62 through line 90 to lines 68 and 66. The exhaust flow in line 68, along with aid of spring 84, cause piston 74 and plunger 76 to move fully to the left. The exhaust flow in line 66 will cause the piston 50 to mover fully to the left. Continued exhaust flow from valve 62 is through lines 90 and 66 to chamber 64 and then through check valves 54 and 52 to lines 48 and 44 which enables the exhaust flow to be vented to surface. Now the valve 62 is fully closed. Valve 62 can now be re-opened as described above by application of pressure to line 44. However, note that in order to return valve 62 to the previous open position (that is occupied before closure) may require multiple pressure applications to line 44. Note also that any gas present in chambers 70 and 64 may affect the ability of piston 74 and plunger 76 to move valve 62 accurately to the next open position.

The present invention presents a control system for a hydraulic control valve, for example, that allows incremental opening in steps by cycling pressure to an opening chamber. Removing pressure to the opening chamber sends the system into a neutral position. Applying pressure to a closing chamber closes the valve by moving the insert sleeve to the closed position. Reapplying pressure after closure on the opening side returns the valve to the position it was in before it was closed. On the other hand, cycling pressure on the closing chamber can allow the valve to be subsequently reopened at any smaller percentage opening than it was in before it was closed. To open the valve to an open percentage that is higher than open position it was in when it was closed, pressure cycles are applied to the opening line. A split j-slot is employed to cycle the valve incrementally toward greater percentage openings on one half of the j-slot while on the separate j-slot the cycling allows the valve to be positioned to subsequently open at a desired percentage opening while staying closed as the cycling takes place. The cycling at either of the separate j-slots allows a travel stop for the insert sleeve to be repositioned. In essence the j-slot cycling creates relative rotation in either direction to extend or retract a travel stop for the insert sleeve. Pressure applied to the opening chamber always urges the insert sleeve to move toward the movable travel stop. Pressure applied to the closing chamber always urges the insert sleeve toward its fully closed position away from the movable travel stop. These and other features of the present invention will be more readily apparent from a review of the description of the preferred embodiment and the associated drawings that appear below with the understanding that the claims set out the full literal and equivalent scope of the invention.

SUMMARY OF THE INVENTION

A hydraulic control system can be used on a downhole choke and has the feature of moving a travel stop for a sliding sleeve using discrete j-slot mechanisms for selectively moving the stop in either one of two opposed directions. The valve can be incrementally opened further with pressure cycling on an opening chamber. The valve can be immediately put to the closed position with pressure on a closing chamber. After closing, the valve can assume its former open position or other selected less open positions by reconfiguring the travel stop while the valve stays in the closed position In order to achieve a higher open percent after closing, one or more pressure cycles must be applied to the open chamber after the valve is reopened to the position it was in before it was closed.

DETAILED DESCRIPTION OF THE PREFERRED EMBODIMENT

Figure 2:
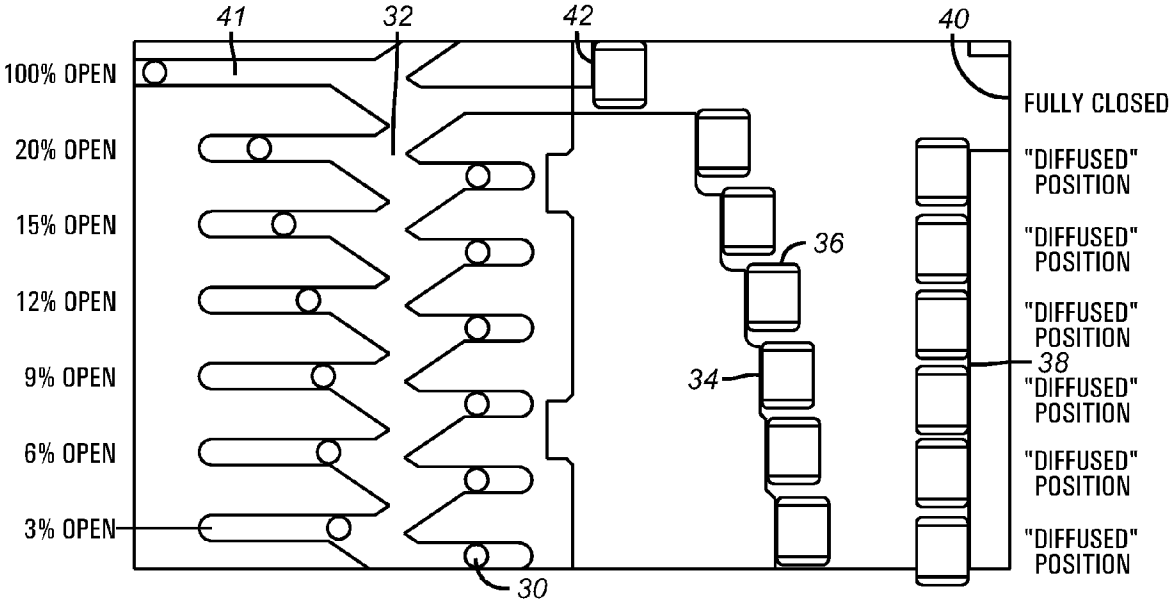
(PRIOR ART) FIG. 2
FIG. 2 is the valve of FIG. 1 showing the j-slot portion of it rolled open.
Figure 1:
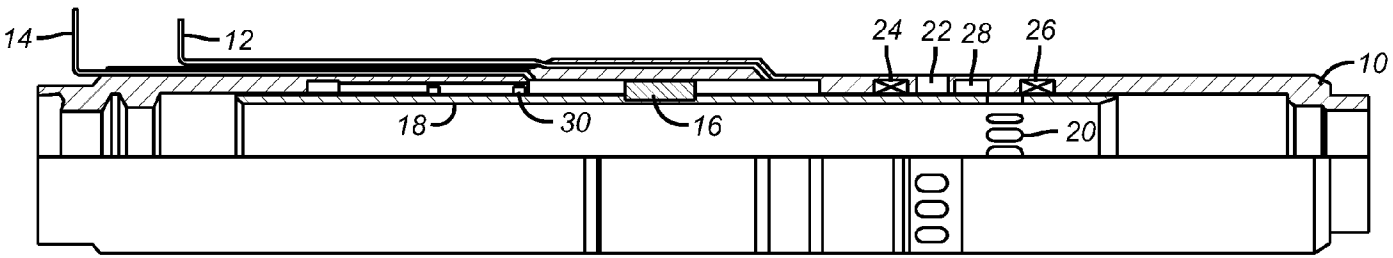
(PRIOR ART) FIG. 1
FIG. 1 is a section view of a known choke valve in the diffused position.
Figure 3:
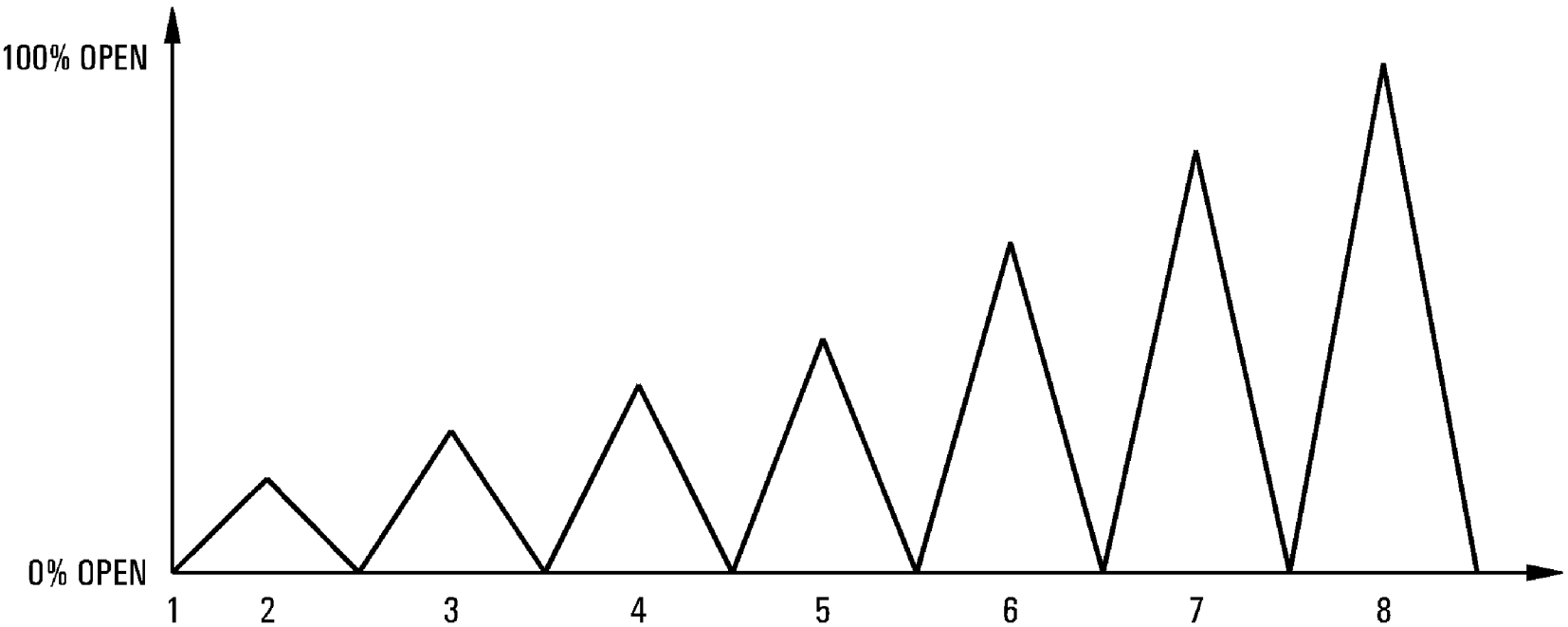
(PRIOR ART) FIG. 3
FIG. 3 shows the progression of percentage open per pressure cycle on the valve of FIG. 1.
Figure 4:
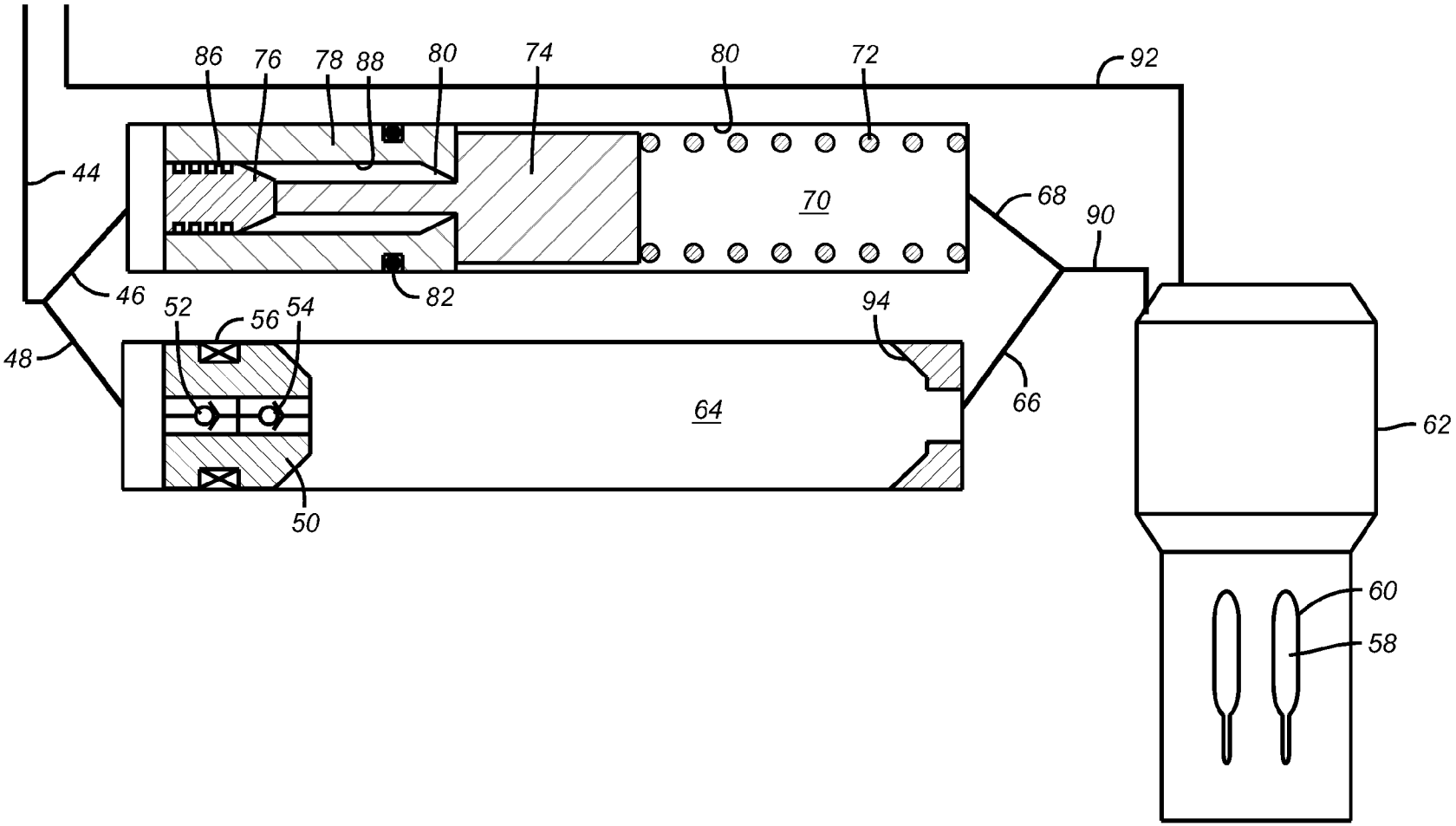
(PRIOR ART) FIG. 4
FIG. 4 is a schematic representation of a different known control system for the valve of FIG. 1 which works on the principle of displacement of a predetermined fluid volume.
Figure 5:
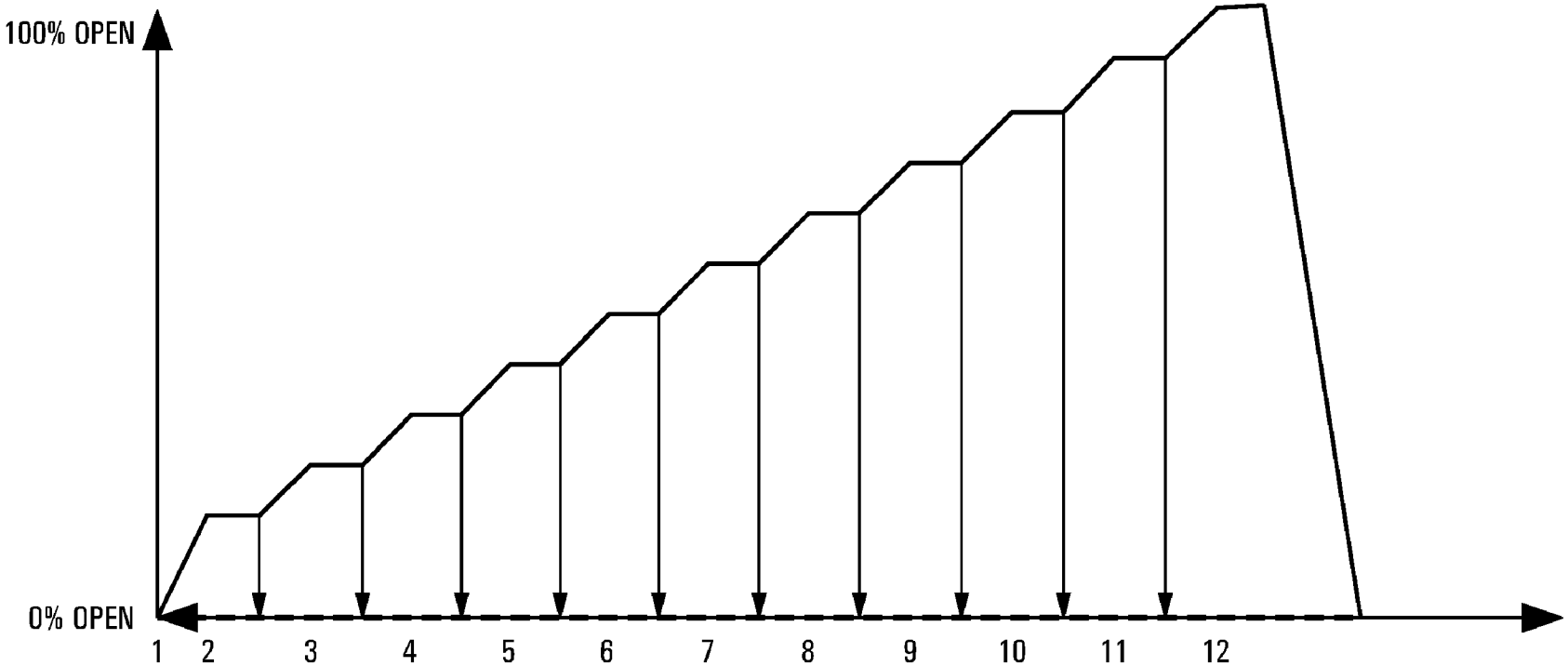
(PRIOR ART) FIG. 5
FIG. 5 is the progression of percentage opening with each cycle for the valve of FIG. 1 using the control system of FIG. 4.
Figure 7:
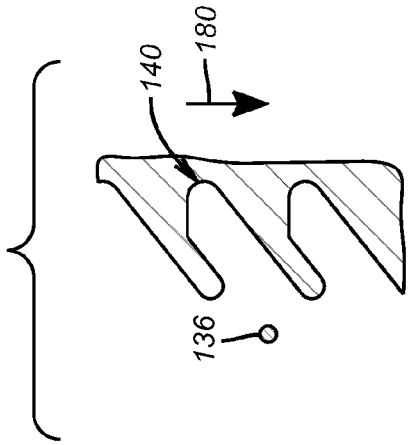
FIG. 7 is a view along section lines 7-7 of FIG. 6.
Figure 8:
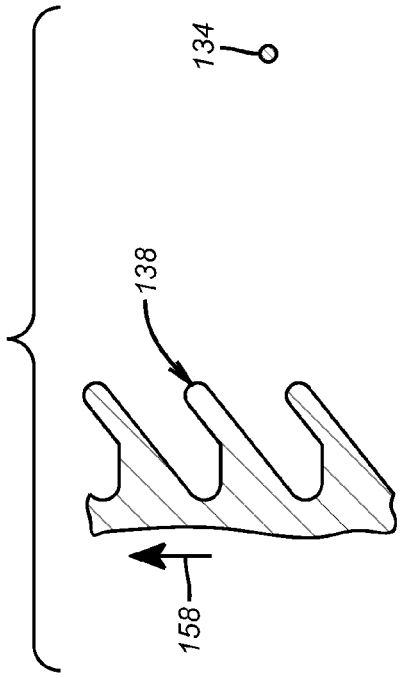
FIG. 8 is a view along section lines 8-8 of FIG. 6.
Figure 6:
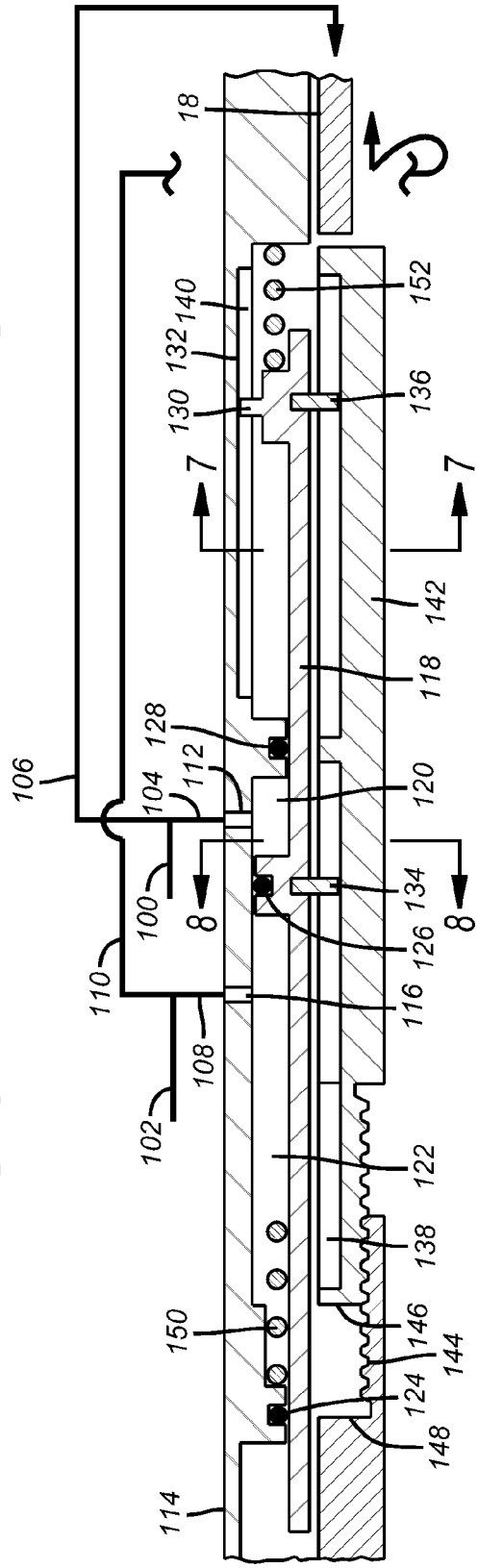
FIG. 6 is a section view of the control system of the present invention in a neutral position.

For continuity, FIG. 6 shows the insert sleeve 18, for the valve in FIG. 1. The present invention is focused on the control system and one application is on a valve with a basic structure as shown in FIG. 1 although uses on other downhole tools are envisioned. There are two control lines 100 and 102 that extend from the surface. Line 100 branches into lines 104 and 106 and line 102 branches into lines 108 and 110. Line 104 goes into opening port 112 in body 114. Line 108 goes to closing port 116 in body 114. A piston 118 defines opening chamber 120 and closing chamber 122 between itself and body 114 with the aid of seals 124, 126 and 128. Piston 118 has a key 130 that rides in track 132 in the body 114 to limit the movement of piston 118 to longitudinal only without relative rotation. Piston 118 supports upper j-slot pin 134 and lower j-slot pin 136. Pin 134 can selectively enter and exit j-slot assembly 138 on travel stop 142 for rotation of travel stop 142 in a manner so as to do up thread 144 to bring top end 146 closer to surface 148 which forms part of the body 114. This is done by cycling pin 134 in and out of the j-slot 138 as will be described below. Similarly, pin 138 can engage j-slot assembly 140 that is on the travel stop 142 as is j-slot assembly 138. Cycling pin 136 in and out of j-slot assembly 140 undoes thread 144 and brings end 146 away from surface 148. Spring 150 urges piston 118 to the right extracting pin 134 out of j-slot 138 and spring 152 urges piston 118 to the left extracting pin 136 out of j-slot 140.

Figure 14:
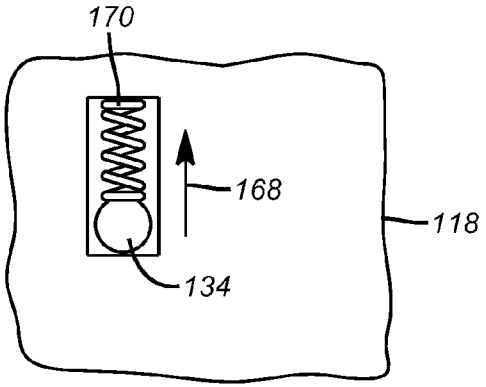
FIG. 14 shows how the pin of FIG. 13 is spring loaded to laterally deflect to allow it to exit from the j-slot without moving the j-slot.
Figure 13:
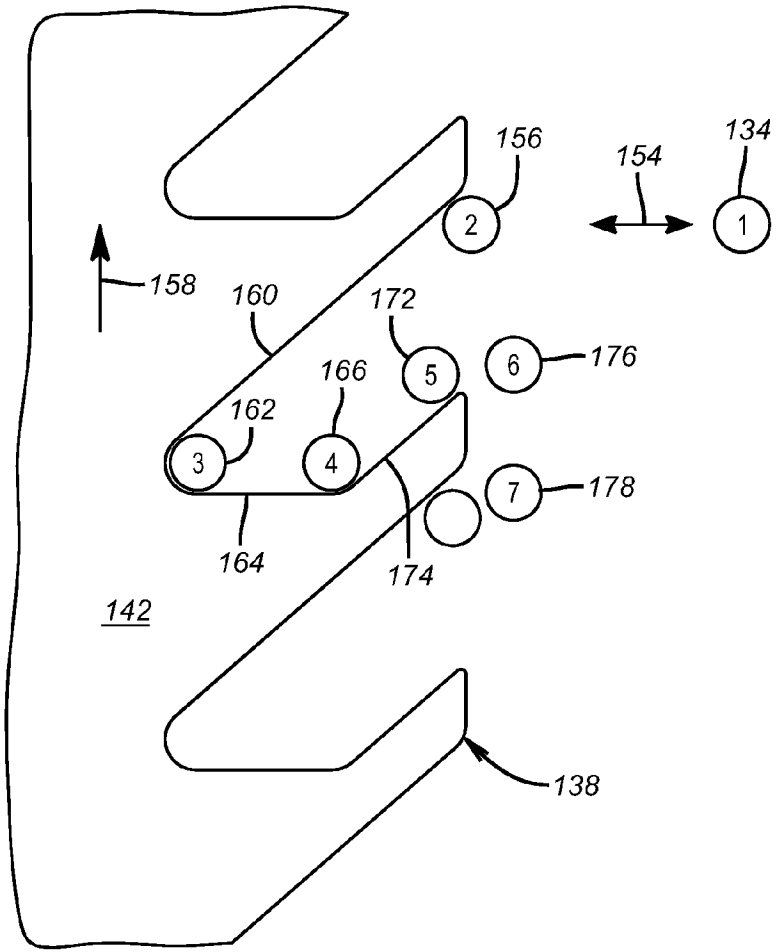
FIG. 13 is a layout of the opening j-slot showing pin movement on the piston and how it moves the j-slot.

Referring to FIGS. 13 and 14 and using pin 134 as an example, FIG. 13 indicates that pin 134 can translate in tandem with piston 118 in opposed directions 154. As the piston 118 moves up to compress spring 150, pin 134 moves into position 156. From that point on any further translation along travel stop 142 by pin 134 will turn stop 142 in direction 158 as pin 134 rides on ramp 160 of the now rotating travel stop 142. When pin 134 gets to position 162 the piston 118 cannot move to further compress spring 150. At that point applied pressure that drives the piston 118 in that direction is removed and spring 150 reverses the motion of piston 118 but still along a longitudinal path 154. Again, piston 118 is keyed at 130 to body 114 and cannot rotate. As a result, pin 134 under the force of spring 150 rides down surface 164 to position 166. As spring 150 continues to push on piston 118, the pin 134 is forced to move transversely to the movement of piston 118 in direction 168 and against the bias of spring 170. This movement allows the pin 134 to ride down ramp 174 to location 172 without rotating the travel stop in a direction opposite to 158. Resisting this tendency of the travel stop to move opposite direction 158 as pin 134 moves from position 166 to 172 is the pitch and friction forces in thread 144. Once clear of the j-slot assembly 138 by moving from position 172 to 176 under bias on piston 118 from spring 150, spring 170 now can relocate pin 134 to the FIG. 14 position and that puts pin 134 in position 178 ready to repeat the cycle just described and incrementally rotate travel stop 142 toward shoulder 146 and in turn allow the insert sleeve 18 to move higher for the next open increment of valve. This process can be repeated from a valve closed position through as many increments as the j-slot assembly 138 has for opening the valve to the full open position. Once full open is obtained the piston 118 has to be cycled in the opposite direction so that pin 136 will move selectively in and out of j-slot 140 to rotate it in direction 180 so as to bring end 146 away from surface 148. The pin 136 is spring loaded so that it can interact with j-slot assembly 140 in the manner described above for pin 134 interacting with j-slot 138 but the movement of the travel stop 142 is in direction 180 rather than 158. It should be noted that although pins 134 and 136 are described as being spring loaded, the same result can be obtained by putting j-slots 138 and 140 on spring loaded sleeves that go over the travel stop 142 while fixedly connecting pins 134 and 136 to piston 118.

It should further be noted that applying pressure in line 100 puts pressure in line 106 that urges the insert sleeve 18 toward travel stop 142. At the same time, pressure also goes to line 104 and into chamber 120 to move piston 118 and pin 134 into selective engagement with j-slot assembly 138. With each application of pressure in line 100 insert sleeve hits the travel stop 142 and pin 134 rotates travel stop 142 along thread 144 to bring end 146 higher or closer to surface 148. With each removal of pressure from line 100 pin 134 is pushed out of j-slot 138 by the action of spring 150. Removal of pressure from line 100 does not shift insert sleeve 18. As pressure cycles in line 100 are repeated the valve opens incrementally but holds it previous position in each pressure release portion of every cycle. The opening increments are preferably identical but they don't have to be. Differing opening increments can be achieved by changing the slope lengths or/and angle of inclination in the j-slot assembly 138.

When pressure cycles are applied to line 102, the pressure in line 110 causes the insert sleeve 18 to go closed. Repeated application and removal of pressure to line 102 will not move insert sleeve away from its closed position. What such cycles through line 108 will do is to cycle pin 136 in and out of j-slot assembly 140 to turn it in direction 180 and to undo thread 144 to bring travel stop 142 away from surface 148. In this manner, the valve can be positioned to where it was before it was closed initially with pressure in line 102 so that the next time after an initial pressure cycle in line 102 a subsequent pressure cycle in line 100 will open the valve to exactly the same percentage opening it was in when it was previously closed. As another option, with the valve having been closed in any given position by applying pressure to line 102, the valve can be manipulated without opening it by pressure cycles in line 102 so that when a pressure cycle is then applied to line 100 the valve can first open to a position different than it was in when it was initially made to close with the first pressure cycle in line 102. In another mode of operation, after the valve is closed with a pressure cycle in line 102 it can then be made to open the next lower increment by adding one cycle to line 102 followed by a cycle in line 100. Going to the next more open increment from closing with a cycle in line 102 is accomplished by first cycling once in line 100 to get the valve to open to the same position that it was in before it closed and then adding as many cycles in line 100 as needed to further open the valve. It should be noted that once the valve is cycled to fully open with pressure cycles in line 100 that it can't continue to be cycled in line 100 to smaller opening positions of the valve. This is because the travel stop 142 is translated by rotating it on thread 144. When travel stop 142 is in its closest position to surface 148 representing the full open position of insert sleeve 18 pushed up against stop 142 by pressure in line 106, that sleeve 142 has to now be rotated in direction 180 by pressure cycles in line 108 to move the travel stop 142 in as many desired increments to the new position needed for the valve to be in when it is made to open with a pressure cycle in line 100.

Figure 9:
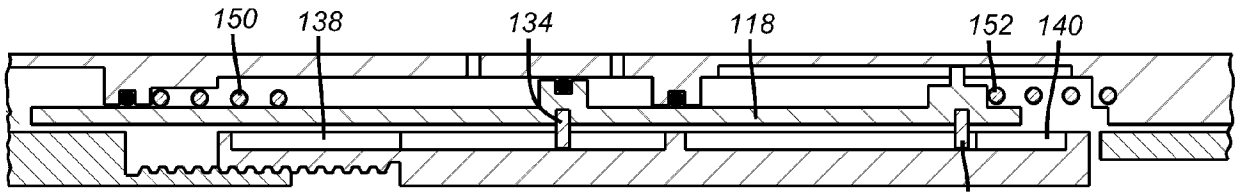
FIG. 9 is a section view of the control system in a neutral position with the valve closed.
Figure 10:
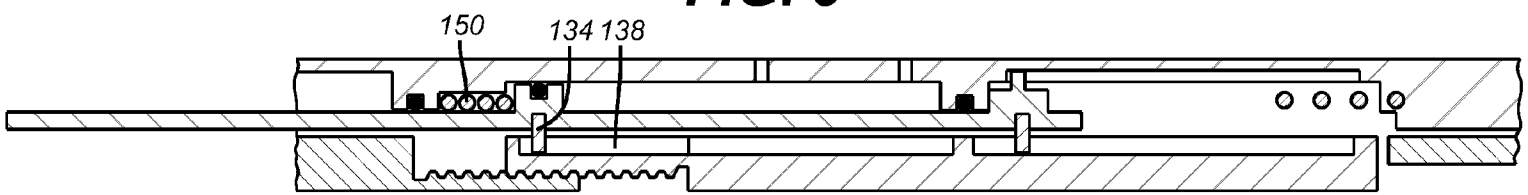
FIG. 10 is the view of FIG. 9 during an opening cycle.
Figure 11:
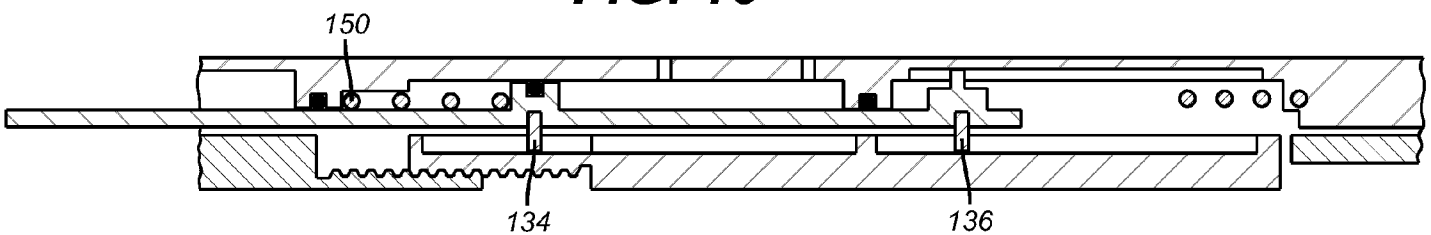
FIG. 11 is the view of FIG. 10 showing the completion of an opening cycle.
Figure 12:
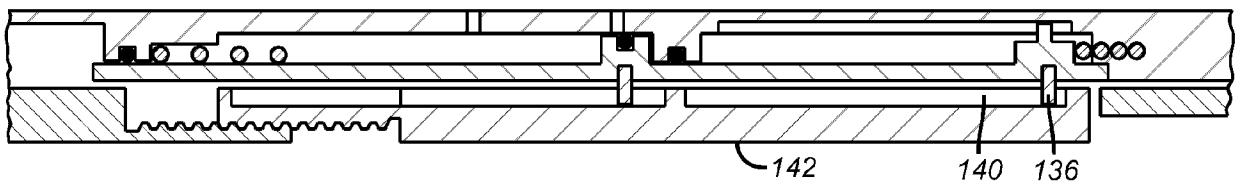
FIG. 12 is the view of FIG. 11 showing the closed position.

FIG. 9 shows the parts in position with no pressure applied to lines 100 and 102 and springs 150 and 152 keeping pins 134 and 136 on piston 118 respectively out of j-slots 138 and 140. In FIG. 10 pressure has been applied to line 100 to engage pin 134 with j-slot 138 while compressing return spring 150. In FIG. 11, the pressure is removed from line 100 and a neutral position for both pins 134 and 136 out of their respective j-slots is assumed with spring 150 now relaxed. Finally in FIG. 12 pressure is applied to line 102 causing pin 136 to engage j-slot 140 to turn travel stop 142 in direction 180.

The present invention provides for a movable travel stop that allows incremental opening of the valve by sequentially shifting a travel stop while using hydraulic pressure to cycle the insert sleeve 18 against it. Cycling in sequence from fully closed to fully open can be accomplished in a series of pressure cycles delivered through line 100. At any time applying pressure to line 102 will force the valve to close. If the very next pressure cycle is in line 100 then the valve will resume the open position it had before it was closed. If the next pressure cycle or cycles after the initial cycle in line 102 is one or more additional cycles in line 102, then the valve will not open but each cycle will bring the travel stop 142 further from surface 148 so that the next time pressure is cycled to line 100 will result in the valve opening but to a position that is not as open as it was when it was closed initially. The pins 134 and 136 that drive their respective j-slots 138 and 140 are preferably spring loaded so that they can exit their respective j-slots without driving their respective j-slots in a direction opposite to the respective intended drive direction.

While the travel stop 142 is shown to be adjusted using a thread 144 a j-slot can also be used to shift its position as piston 118 moves back and forth. While the control system is shown for use in the preferred embodiment for use with a choke it can be used with other downhole tools that operate by a series of discrete movements to accomplish a task downhole.

It is to be understood that this disclosure is merely illustrative of the presently preferred embodiments of the invention and that no limitations are intended other than as described in the appended claims.

I claim:

1. A downhole tool, comprising:

a housing for subterranean use and a member selectively movable in said housing into a plurality of positions including first and second end positions and at least one position in between said end positions to perform an operation at a subterranean location;

said member movable against a single movable travel stop sequentially in a direction from said first toward said second position and selectively movably in the reverse direction directly back to said first position from every other position available for said member and, subsequently to such movement in the reverse direction, can be returned directly to the position occupied before movement was initially reversed, said returning available from every other position to define multiple positions for said movable member.

2. A downhole tool, comprising:

a housing and a member selectively movable in said housing into a plurality of positions including first and second end positions and at least one position in between said end positions;

said member movable against a single movable travel stop sequentially in a direction from said first toward said second position and selectively movably in the reverse direction directly back to said first position from every other position available for said member and, subsequently to such movement in the reverse direction, can be returned directly to the position occupied before movement was initially reversed, said returning available from every other position to define multiple positions for said movable member;

a control system to selectively axially reciprocate said member, said travel stop operably connected to said control system for discrete axial movement to define a plurality of contact locations between said travel stop and said member with respect to said housing.

3. The tool of claim 2, wherein:

said member disposed in a flow passage through said housing and selectively assumes positions at and between an open and closed position for said passage;

said control system sequentially moving said travel stop in a first direction to define positions for said member that progressively remove restriction of said passage as said member engages said travel stop.

4. The tool of claim 3, wherein:

said control system putting said member in said closed position when initiating movement of said travel stop in a second direction opposite said first direction.

5. The tool of claim 4, wherein:

said control system keeps said member at said closed position while said travel stop is moved sequentially in said second direction.

6. The tool of claim 4, wherein:

said control system can move said member from any non-closed position to the closed position and directly return said member to the non-closed position said member was in before said member closed.

7. The tool of claim 5, wherein:

said control system can move said member from any non-closed position to the closed position and directly return said member to the non-closed position said member was in before said member closed.

8. The tool of claim 2, wherein:

said control system moves said member and said travel stop selectively in tandem or one of said member and said travel stop.

9. A downhole tool, comprising:

a housing and a member selectively movable in said housing;

said member movable against a single movable travel stop to define multiple positions for said movable member;

a control system to selectively axially reciprocate said member, said travel stop operably connected to said control system for discrete axial movement to define a plurality of contact locations between said travel stop and said member with respect to said housing;

said control system moves said member and said travel stop selectively in tandem or one of said member and said travel stop;

said control system is hydraulically linked to said member and said travel stop;

said hydraulic linking to said travel stop further comprises a hydraulically operated reciprocating piston whose opposed movement is converted to rotation of said travel stop about a thread on which said travel stop is mounted.

10. The tool of claim 9, wherein:

movement of said piston in a first direction moves said travel stop away from said member and movement of said piston in a second direction opposite said first direction reverses the movement of said travel stop.

11. The tool of claim 10, wherein:

said piston is linked to said travel stop by at least one j-slot assembly; and said piston is restrained against rotation by said body.

12. The tool of claim 11, wherein:

said piston is linked to said travel stop by discrete j-slot assemblies that are opposite hand so that contact between a plurality of pins and their respective track defining said j-slot assemblies results in rotation of said travel stop in opposite directions about said thread.

13. The tool of claim 12, wherein:

said piston is biased in opposed directions to disengage said plurality of pins from their respective track when no hydraulic pressure is applied to said control system.

14. The tool of claim 13, wherein:

said control system further comprises an opening hydraulic line and a closing hydraulic line, said opening hydraulic line, when pressurized, driving said member toward said stop and said piston in the same direction as said member and against said bias force so that a first said pin mounted to said piston enters the respective track for said pin connected to said travel stop to reposition said travel stop in the same direction as said piston movement during pressurization of said opening hydraulic line by rotation of said travel stop.

15. The tool of claim 14, wherein:

depressurizing said opening hydraulic line allows said bias to reverse the movement of said piston from when said opening hydraulic line was pressurized, whereupon said first pin moves transversely to said piston and against a bias force to allow said first pin to exit the respective track for said pin without rotating said travel stop.

16. The tool of claim 15, wherein:

sequential cycles of pressurizing and depressurizing said opening hydraulic line sequentially moves said travel stop in a first direction to a first end position;

said housing comprising a passage therethrough selectively obstructed by said member, said passage being least obstructed when said member contacts said travel stop in said first end position of said stop.

17. The tool of claim 16, wherein:

said closing hydraulic line, when pressurized, driving said member away from said stop and said piston in the same direction as said member and against said bias force so that a second said pin mounted to said piston enters the respective track for said pin connected to said travel stop to reposition said travel stop in the same direction as said piston movement during pressurization of said closing hydraulic line, by rotation of said travel stop.

18. The tool of claim 17, wherein:

depressurizing said closing hydraulic line allows said bias to reverse the movement of said piston from when said closing hydraulic line was pressurized, whereupon said first pin moves transversely to said piston and against a bias force to allow said first pin to exit the respective track for said pin without rotating said travel stop;

said member remaining stationary, in a position where said passage in said housing is most obstructed, during said depressurizing said closing hydraulic line and during subsequent cycles of pressurizing and depressurizing said closing hydraulic line.

19. The tool of claim 18, wherein:

sequential cycles of pressurizing and depressurizing said closing hydraulic line sequentially moves said travel stop opposite said first direction to a second end position.

20. The tool of claim 17, wherein:

said member again assumes the same position in said passage that said member had when said closing hydraulic line was pressurized, if, after depressurizing said closing hydraulic line that follows its initial pressurization, is then immediately followed by pressurization of said opening hydraulic line.

* * * * *